United States Patent [19]

Mancini et al.

[11] 4,025,447

[45] May 24, 1977

[54] ESTERS AS COMPONENTS OF LUBRICANTS

[75] Inventors: Giuseppe Mancini, Melegnano; Luigi Imparato, Milan; Dario Schillani, Peschiera Borromeo, all of Italy

[73] Assignee: Snam Progetti S.p.A., Milan, Italy

[22] Filed: Apr. 29, 1975

[21] Appl. No.: 572,651

[30] Foreign Application Priority Data

May 8, 1974 Italy ..... 22398/74

[52] U.S. Cl. ..... 252/56 S; 106/243; 260/410.6

[51] Int. Cl.[2] ..... C10M 3/20

[58] Field of Search ..... 252/56 S; 260/410.6; 106/243

[56] References Cited

UNITED STATES PATENTS

| | | | |
|---|---|---|---|
| 3,048,608 | 8/1962 | Girard | 252/56 S |
| 3,309,318 | 3/1967 | Aylesworth | 252/56 S |
| 3,694,382 | 9/1972 | Kleiman | 260/410.6 |

*Primary Examiner*—Theodore Morris
*Attorney, Agent, or Firm*—Ralph M. Watson

[57] ABSTRACT

This invention relates to esters prepared by reacting a. a mixture of tri-, tetra- and hexafunctional polyols in which the molar ratio of the trifunctional polyol to the other polyols is from about 0.5:1 to 10:1 and in which the molar ratio of the hexafunctional polyol to the tetrafunctional polyol is from about 0 to 1.2:1, and b. a mixtue of linear alkyl monocarboxylic acids comprised of (i) one or more acids having from 7 to 8 carbon atoms and (ii) one or more acids having from 12 to 18 carbon atoms, the molar ratio of the acids (i) to the acids (ii) being from about 1.5:1 to 6:1.

The invention also relates to lubricating compositions comprised of the esters.

12 Claims, No Drawings

ESTERS AS COMPONENTS OF LUBRICANTS

This invention relates to synthetic products and particularly to organic esters suitable for use in the formulation of lubricants for internal combustion engines.

The use of synthetic components results in multigrade lubricants that more easily overcome the inconveniences which often are met when lubricants having natural bases are used such as the presence of extremely fluid mineral fractions, introduced for obtaining the desired viscosities at low temperature and the necessity of high percentages viscosity index improvers additives.

The synthetic based lubricant to be utilized for this purpose must advantageously possess suitable characteristics. In the case of use in motor-car engines it is necessary for the product to have a low volatility in relation to its viscosity. In addition, the product should have such viscosity-temperature characteristics so to easily permit a cool starting and at the same time to ensure a good lubrication at the maximum temperatures obtainable during running. Furthermore, the synthetic based lubricant must possess high thermal stability, good resistance against oxidation and good lubricating power.

The products which are the object of the invention can be used as such or in mixture with mineral oils. According to a chemical point of view they result from the reaction between two or more different types of polyhydroxylic compounds and two or more different types of monocarboxylic acids. The employed chemical types and the ratios among the different chemical types are suitably defined so to supply products having particular features.

Generally the esters obtained from polyols with a neopentylic structure (like the ones hereinafter described) are decidedly more advantageous than the other ones as to the thermal stability and to the oxidation resistance; however, often they present drawbacks in the behaviour at the low temperatures both in relation to the viscosity and in relation to the pour point. Furthermore, they show generally low viscosity indices.

A worsening of the viscosity index occurs when it is tried to improve the pour point by decreasing the molecular weight of the monocarboxylic acids or inserting branched acids in the structure. A major object of the present invention is to prepare products which even in view of the known characteristics of stability of the neopentylpolyols esters do not present pour drawbacks at the low temperatures and possess a high viscosity index. In particular, the desired esters have a high stability under operating conditions which permit obtaining in mixture with the mineral bases, formulations characterized by a satisfactory behaviour of the viscosity curve, a low volatility and a good fluidity even at the low temperatures.

The polyhydroxylic compounds used for this purpose are of the following type:

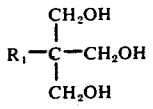

wherein $R_1$ may be $CH_2OH$ or $-C_2H_5$, or:

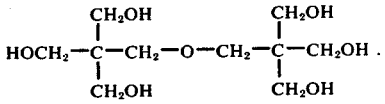

The monocarboxylic acids are of the R — COOH type wherein R is a linear hydrocarbon radical having from 6 to 17 carbon atoms.

The process, hereinafter described in detail, comprises reacting in fixed ratios and in a single stage (a) a mixture of neopentylic polyols having a different functionality, with (b) two groups of acids, one of them comprising acids having 7 and/or 8 atoms of carbon and the other one comprising acids with a number of carbon atoms which ranges from a minimum of 12 to a maximum of 18.

In particular, a group of neopentylpolyols wherein at least one compound with a functionality higher than 3 (functionality means number of hydroxyls) is always present, is made to react with a group of acids comprised of at least one monocarboxylic acid with 12 or more carbon atoms. The group of neopentylpolyols and the one of the monocarboxylic acids are constituted in the following way:

a. Group of neopentylpolyols

There are always present a trifunctional compound of the type:

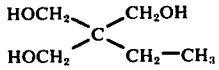

and compounds of higher functionality, shown hereinafter, in such ratios that the molar ratio between the trifunctional compound and the other ones is not lower than 0:5:1 and not higher than 10:1.

The compounds having a functionality higher than 3 are of the type:

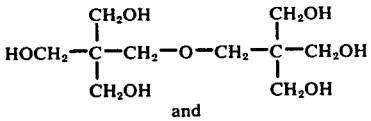

and

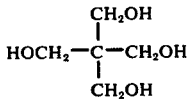

and must be present in a molar ratio between the first one and the second one comprised between 0 and 1.2.

b. Group of the monocarboxylic acids

There are present always one or more acids of the type $CH_3(CH_2)_n$ — COOH with $n = 5$ or $n = 6$ and one or more acids of the same type but with $n$ which can range from 10 to 16 in such ratios that the molar ratio between the addition of the acids having $n$=5 or 6 and the addition of the other present acids is comprised between 1.5 and 6.

The reaction between acids and polyols occurs in a single phase and can be carried out in the presence or in the absence of a solvent and at temperatures ranging from 70° to 260° C, preferably between 150° and 250° C. Illustrative solvents are benzene or toluene which form an azeotropic mixture with the water of reaction. In the absence of solvent the water removal can occur by stripping with nitrogen or another inert gas or by carrying out the reaction under a moderate vacuum.

The reaction can occur in the presence or in the absence of a catalyst such as the ones normally used in esterification reactions. Metasulphonic acid is particularly useful in this regard.

If a nonvolatile acid catalyst is used, the treatment after the reaction comprises washing with an alkaline aqueous solution and then successively with water, followed by stripping with inert gas or at reduced pressure for removing traces of water or byproducts having a lower boiling point.

If a catalyst has not been employed, the alkaline washing can be avoided by directly subjecting the raw product to stripping and possibly eliminating the residual acids through one of the methods used for this purpose and known in carrying out esterification, as for instance a treatment with solid adsorbers separable through filtration.

The results reported below show that it is possible according to this invention to obtain esters having characteristics higher than the ones of the conventional products.

EXAMPLE 1

Product A

In a glass flask, provided with a stirrer, nitrogen immission inlet, a thermometer and a water separator with relative cooler under a nitrogen flow, 1.147 moles of dodecanoic acid (229.4 g), 1.953 moles of heptanoic acid (254.26 g), 0.9 mole of trimethylolpropane (TMP) (120.76 g), 0.1 mole of pentaerythritol (PE) (13.61 g) were made to react.

Gradually the temperature was increased, so that after about 2 and one half hours of reaction it reached about 210° C. In the following 4 hours it was maintained at 215°–220° C and finally it was raised to 230°–240° C for still other 12 hours, while in the separator was collected the majority of the reaction water.

At this point an excess of the initial acid mixture in the amount corresponding to the 10% of the amount already introduced, was added, and then the reaction was made to continue for a further 4 hours at 230° C.

Then the stripping started in a nitrogen flow at 230° C. After 3 hours the acidity decreased at 0.3 mg KOH/g and the viscosity was of 5 cs at 210° F. The stripping continued for an hour, reaching an acidity of 0.05 mg KOH/g. The yield was 94%.

EXAMPLE 2

Product B 0.34 mole of TMP (45.6 g), 0.075 mole of PE (10.2 g), 0.085 mole of dipentaerythritol (DPE) (21.6 g), 1.464 moles of heptanoic acid (190.6 g), 0.22 mole of dodecanoic acid (44.1 g), 0.146 mole of hexadecanoic acid (37.44 g) are made to react.

To complete the reaction 68 grams of the starting mixture of acids were added.

A stripping under a nitrogen flow was carried out, a filtration followed, and the acidity was measured as 2 mg KOH/g. Then a treatment with alumina was effected taking the acidity to 0.65 mgKOH/g and obtaining a viscosity at 210° F of the final product of 6.21 cs.

EXAMPLE 3

Product C 0.15 mole of TMP (20.13 g), 0.2 mole of PE (27.23 g), 0.075 mole of DPE (19.05 g), 0.051 mole of hexadecanoic acid (13.08 g), 0.204 mole of dodecanoic acid (40.86 g), 0.68 mole of octanoic acid (98.07 g), 0.765 mole of heptanoic acid (99.6 g) were made to react; for simple stripping in a nitrogen flow the final acidity of the product reached 0.1 mg KOH/g while the viscosity at 210° F was 6.61 cs.

EXAMPLE 4

Product D 0.13 mole of DPE (33.02 g), 0.20 mole of PE (27.23 g), 0.17 mole of TMP (22.81 g) 1.105 moles of heptanoic acid (143.86), 0.65 mole of octanoic acid (93.74 g), 0.334 mole of dodecanoic acid (66.9 g) were used.

After a stripping with nitrogen and a final filtration an acidity of the product of 0.04 mg KOH/g was obtained.

The viscosity at 210° F was 6.65 cs.

EXAMPLE 5

Product E

We started from 0.32 mole of TMP (42.9 g), 0.10 mole of PE (13.6 g), 0.08 mole of DPE (20.3 g), 0.368 mole of dodecanoic acid (73.7 g), 0.920 mole of heptanoic acid (119.8 g), 0.552 mole of octanoic acid (79.6 g).

The finished product had a viscosity at 210° F of 5.85 cs and an acidity of 0.84 mg KOH/g.

The characteristics of the products were reported in the following table. Hence $V_{100}$, $V_{210}$ and V.I. respectively mean the viscosity in cs at 100 and at 210° F and the viscosity index, ASTM D 2270.

Characteristics of the obtained products

| | $V_{100}$ | $V_{210}$ | VI | Pour point ° C |
|---|---|---|---|---|
| Product A | 24.35 | 5.01 | 149 | −33 |
| Product B | 33.13 | 6.21 | 151 | −30 |
| Product C | 37.34 | 6.61 | 144 | −33 |
| Product D | 38.21 | 6.65 | 142 | −36 |
| Product E | 30.61 | 5.85 | 150 | −30 |

By examining these results it is possible to see that the series of the obtained products appears with rheological characteristics which are not met in the conventional compounds, namely, those prepared by reacting PE, DPE or TMP and monocarboxylic acids. In fact among the esters of such a kind hitherto known, none passes viscosities comprised between 5 and 7 cs at 210° F, a viscosity index higher than 140, a pour point of −30° C or less.

For instance in the PE series, the products which achieve the viscosities already reported are solid at about 0° C, such as the tetraoctanate ester which has a $V_{210}$ of 5.49 cs and a viscosity index of 144 and the tetranonanate ester which has a $V_{210}$ of 6.47 cs and a V.I. of 146. By employing branched acids the characteristics at low temperatures are improved but the viscosity index is in turn lowered. For example, the product of PE, esterified with 2-ethyl-butanoic acid ($V_{210}$ = 6.46), has a pour point of −34° C and a viscosity index of 40.

Also, the derivatives of TMP which are comprised in the viscosity range of 5–7 cs at 210° F (esters of the acids higher than the nonanoic acid) show drawbacks as to the pouring at low temperatures.

In the most favourable cases (which correspond to the lower zone of the fixed range of viscosity) the pour point is always higher than −20° C. Improvements at the expense of the viscosity index can occur, as in the case of the tetraisooctanoate ester which has a pour point of −43° C and a viscosity index of 99; however, the viscosity reaches only 5.05 cs at 210° F.

Short chain ester derivatives of DPE have viscosities out of the indicated viscosity range. For example, the hexabutanate ester has a $V_{210}$ higher than 8 cs.

Products having a viscosity index lower than 140 are always involved if a pour point at least lower than 0° C is required.

By using mixtures of acids instead of, as previously shown, using single acids, in no case it is possible to reach the results obtainable with the process illustrated in this invention.

For instance, products obtained by employing mixtures of linear acids are known, as are products obtained using mixtures of branched acids or acids which are both linear and branched. However, it is possible to verify that in these cases high indices are not obtained, unless products at a high pour point are into consideration. For instance, TMP with nonanoic and isodecanoic acids gives an ester having $V_{210}$ = 6.25 cs, V.I. = 106, pour point = −46° C; with pentanoic, 2-ethylhexanoic, tetradecanoic acids, a product is obtained having $V_{210}$ = 5.83 cs, V.I. = 131, pour point = −7° C. Analogously, PE with isooctanoic and nonanoic acids gives an ester having $V_{210}$ = 6.81 cs, V.I. = 115, pour point = −40° C; with a mixture of heptanoic and nonanoic acids gives an ester having $V_{210}$ = 5.23 cs, V.I. = 125, pour point = −20° C; with a mixture of octanoic, nonanoic and decanoic acids gives an ester having $V_{210}$ = 6.42 cs, V.I. = 143, pour point = +4° C.

The products of this invention have several uses, one of which is in the formulation of multigrade lubricating oils. The lubricating oils may be comprised of the ester produced or, if the oil has a natural base, of a mineral oil and the ester, the ratio of the mineral oil to the ester being from about 1:1 to 3:1. The lubricating oil may also contain one or more additives.

The use of the esters of this invention in a natural base lubricating oil permits obtaining the limits of viscosity required at high and low temperatures with apparent advantages over conventional formulations. In fact, the percentage of polymer additives to improve the viscosity index can be minimized, and it is no longer necessary to include mineral fluid fractions, the known volatility of which has a negative effect on consumption.

We claim:

1. An ester prepared by reacting a. a mixture of tri-, tetra- and hexafunctional polyols in which the molar ratio of the trifunctional polyol to the other polyols is from about 0.5:1 to 10:1 and in which the molar ratio of the hexafunctional polyol to the tetrafunctional polyols is from about 0 to 1.2:1, and b. a mixture of linear alkyl monocarboxylic acids comprised of (i) one or more acids having from 7 to 8 carbon atoms and (ii) one or more acids having from 12 to 18 carbon atoms, the molar ratio of acids (i) to acids (ii) being from about 1.5:1 to 6:1.

2. An ester prepared by reacting a. a mixture of tri-, tetra- and hexafunctional polyols in which the molar ratio of the trifunctional polyol to the other polyols is from about 0.5:1 to 10:1 and in which the molar ratio of the hexafunctional polyol to the tetrafunctional polyols is from about 0 to 1.2:1, and b. a mixture of linear alkyl monocarboxylic acids comprised of (i) one or more acids having from 7 to 8 carbon atoms and (ii) one or more acids having from 12 to 18 carbon atoms, the molar ratio of acids (i) to acids (ii) being from about 1.5:1 to 6:1, said ester being characterized by having a viscosity of from about 5 to 7 cs at 210° F, a viscosity index higher than 140, and a pour point of −30° C or less.

3. An ester of claim 2 wherein the polyols are trimethylolpropane, pentaerythritol, and dipentaerythritol.

4. A mixture of two or more esters of claim 2

5. An ester prepared by reacting a. a mixture of trimethylolpropane, pentaerythritol, and dipentaerythritol in which the molar ratio of the trimethylolpropane to the other polyols is from about 0.5:1 to 10:1 and the molar ratio of the dipentaerythritol to the pentaerythritol is from about 0 to 1.2:1, and b. a mixture of linear alkyl monocarboxylic acids comprised of (i) one or more acids having from 7 to 8 carbon atoms and (ii) one or more acids having from 12 to 18 carbon atoms, the molar ratio of acids (i) to acids (ii) being from about 1.5:1 to 6:1, said ester being characterized by having a viscosity of from about 5 to 7 cs at 210° F, a viscosity index higher than 140, and a pour point of −30° C or less.

6. A mixture of two or more of the esters prepared in claim 5.

7. A lubricating composition comprising one or more of the esters of claim 2.

8. A lubricating composition comprising one or more of the esters of claim 5.

9. A lubricating composition comprising a mineral oil, and one or more of the esters of cliam 2.

10. A lubricating composition comprising a mineral oil, and one or more of the esters of claim 5.

11. A method of lubricating an internal combustion engine which comprises employing a lubricating composition comprising one or more of the esters of claim 2.

12. The method of claim 11 wherein the lubricating composition also comprises a mineral oil.

* * * * *